US012740633B2

(12) United States Patent
Macchione

(10) Patent No.: US 12,740,633 B2
(45) Date of Patent: Sep. 22, 2026

(54) HANDS-FREE PET WALKER UTILITY BAG

(71) Applicant: Pilar Macchione, New York, NY (US)

(72) Inventor: Pilar Macchione, New York, NY (US)

( * ) Notice: Subject to any disclaimer, the term of this patent is extended or adjusted under 35 U.S.C. 154(b) by 151 days.

(21) Appl. No.: 18/308,545

(22) Filed: Apr. 27, 2023

(65) Prior Publication Data

US 2023/0346111 A1 Nov. 2, 2023

Related U.S. Application Data

(60) Provisional application No. 63/473,051, filed on Apr. 28, 2022.

(51) Int. Cl.
*A45F 3/02* (2006.01)
*A45F 3/00* (2006.01)

(52) U.S. Cl.
CPC ..... *A45F 3/02* (2013.01); *A45F 2003/003* (2013.01)

(58) Field of Classification Search
CPC ... A45F 3/02; A45F 2003/003; A01K 27/008; E01H 2001/1273
USPC ..... 119/796; 224/162
See application file for complete search history.

(56) References Cited

U.S. PATENT DOCUMENTS 7,073,462 B1 * 7/2006 Layman ..... A01K 27/008 119/867
7,367,286 B2 * 5/2008 Beaupre ..... A01K 27/006 119/795
9,049,910 B1 6/2015 Bakali
9,345,942 B2 * 5/2016 Stevens ..... A63B 69/18
10,426,130 B2 * 10/2019 Torres ..... A45C 13/004
D886,396 S 6/2020 Xu
D968,038 S 10/2022 Li
11,457,611 B2 10/2022 Moeller
D968,723 S 11/2022 Xiao
D971,525 S 11/2022 Li
D975,934 S 1/2023 Wu
D978,453 S 2/2023 Jiang
11,589,557 B2 2/2023 Walters
11,602,338 B2 3/2023 Albrecht
2012/0193386 A1 8/2012 McFarland
2016/0135432 A1 * 5/2016 Cox ..... A01K 27/008 119/795
2016/0219838 A1 * 8/2016 Flaig ..... A01K 27/004
2016/0367021 A1 * 12/2016 Moreau ..... A41D 1/04
2017/0013807 A1 1/2017 Johnson
2019/0261765 A1 * 8/2019 Alonzo ..... A45C 13/10
2020/0332485 A1 * 10/2020 Garland ..... A45F 5/02
2022/0015328 A1 1/2022 Ross
(Continued)

OTHER PUBLICATIONS

Thefashionprofessor.com, visited on Jan. 25, 2021 via the Wayback Machine. (Year: 2021).*

(Continued)

*Primary Examiner* — Scott T McNurlen

(57) ABSTRACT

The present disclosure relates to bag device worn on the shoulder or across the body that contains a pocket capable of securing a retractable leash and a double besom opening to allow threading of leash tether from inside the pocket to a pet harness outside the bag. This allows for walking a pet hands-free without the risk of the leash being inadvertently tangling or detaching from the bag. The bag is particularly useful for walking pets by individuals with physical impairments.

11 Claims, 3 Drawing Sheets

(56) References Cited

U.S. PATENT DOCUMENTS

| | | | |
|---|---|---|---|
| 2022/0354090 | A1 | 11/2022 | Medeiros et al. |
| 2023/0055110 | A1 | 2/2023 | Cusack |

OTHER PUBLICATIONS

Molle Flexi Pouch. Product Catalogue [webpage]. Ray Allen Manufacturing, 2021. webpage <https://www.rayallen.com/molle-flexi-pouch/>, Nov. 29, 2021, retrieved from Internet Archive Wayback Machine <https://web.archive.org/web/20211129084028/https://www.rayallen.com/molle-flexi-pouch/>.

"Retractable Dog Leash for Small Dogs Cats up to 11lbs with 6.5ft Anti-Pull Strong Nylon Tape, Hands Free, Mini and Portable Walking Leash with Wrist Strap, One-Hand Brake, White Round". Product Catalogue [webpage]. Cugbcug, Amazon, Apr. 30, 2021. Retrieved from the Internet: <URL: https://www.amazon.com/Retractable-Anti-Pull-Portable-Walking-One-Hand/dp/B092CP4RTQ/ref=sr_1_1?crid=4LBLRK4YA03J&keywords=b092cp4rtq&qid=1690427842&sprefix=%2Caps%2C155&sr=8-1&th=1>.

"Retractable Hands Free Dog Leash, 360° Tangle-Free Heavy Duty Wrist Dog Walking Leash with 8.2 ft strong Cord and Reflective Nylon Tape, One Button Brake, Pause, Lock for Small Dog or Cat up to 55 lbs". Product Catalogue [webpage]. Xiangxing, Amazon, Mar. 23, 2020. Retrieved from the Internet: <URL: https://www.amazon.com/Retractable-Tangle-Free-Walking-strong-Reflective/dp/B08686L1Y6/ref=sr_1_1?crid=39HE10RIUO3OL&keywords=b08686l1y6&qid=1690427986&sprefix=%2Caps%2C90&sr=8-1>.

"Furiends—Retractable Wearable Dog Leash with Bright LED Light | Rechargeable with Type C, Donut Shape, 10 ft Traction Rope and Quick Brake—(for Small and Medium Furry Friends Up to 40 LBS)—Black". Product Catalogue [webpage]. Furiends, Amazon, Jun. 9, 2021. Retrieved from the Internet: <URL: https://www.amazon.com/Furiends-Retractable-Wearable-Rechargeable-Traction/dp/B096XVQ7KT/ref=sr_1_1?crid=TNYS1JTWUA43&keywords=b096xvq7kt&qid=1690428206&sprefix=%2Caps%2C104&sr=8-1>.

"Doddle | Retractable Leash and Collar in One | Fear Free | Medium | 13-17" Neck". Product Catalogue [webpage]. Himalayan Dog Chews, Amazon, Nov. 2, 2018. Retrieved from the Internet: <URL: https://www.amazon.com/Himalayan-Pet-Supply-Doddle-Collar/dp/B07K4STJK1/ref=sr_1_1?crid=3I1SFVHSDTBVL&keywords=b07k4stjk1&qid=1690428312&sprefix=%2Caps%2C143&sr=8-1>.

Pet Ownership and Demographics Sourcebook. American Veterinary Medical Association, Veterinary Economics Devision [webpage]. May 2022. Retrieved from the Internet:<URL:https://ebusiness.avma.org/files/ProductDownloads/eco-pet-demographic-report-22-low-res.pdf> <ISBN: 978-1-882691-57-9>.

Trainer, "Service dogs save lives". [webpage]. ShareAmerica. Sep. 30, 2016. Retrieved from the Internet <URL: https://share.america.gov/service-dogs-save-lives/>.

Nelson, "Best U.S. Cities for Dogs: Pet-Friendliest Places in 2023" [webpage] Pawlicy Advisor, 2022. webpage https://www.pawlicy.com/blog/best-cities-for-dogs/>, May 16, 2022, retrieved from Internet Archive Wayback Machine <https://web.archive.org/web/20220516220004/https://www.pawlicy.com/blog/best-cities-for-dogs/>.

Maxson, Ridge; Leland, Christopher R.; McFarland, Edward G.; Lu, Jim; Meshram Prashant; Jones, Vanya C.. Epidemiology of Dog Walking-Related Injuries among Adults Presenting to US Emergency Departments, 2001-2020. Medicine & Science in Sports & Exercise 55(9):p. 1577-1583, Sep. 2023. | DOI: 10.1249/MSS.0000000000003184.

* cited by examiner

HANDS-FREE PET WALKER UTILITY BAG

RELATED CASE

This application claims the benefit under 35 U.S.C. § 119(e) of U.S. Provisional Patent Application Ser. No. 63/473,051 titled, "The Teddy Bag/Dog Walker Utility Bag" and filed Apr. 28, 2022.

FIELD OF THE INVENTION

The present invention generally relates to a human-wearable pet-walking device. More specifically, the present invention relates to an easy to carry human-wearable pet-walking bag device equipped with a pocket capable of securing a retractable leash system, and a double besom opening to allow the threading of a leash tether from inside the bag to a pet harness outside of the bag. This can allow for walking a pet hands-free without the risk of the leash being inadvertently detached from the bag or getting tangled. The bag is particularly useful for users with disabilities that impair their ability to operate a leash, such as those suffering from multiple sclerosis.

SUMMARY OF THE INVENTION

Among the various aspects of the present disclosure is a bag device worn on the shoulder or across the body that contains a functional pocket located on the inside of the bag, said functional pocket comprising an opening to the outside of the bag. The functional pocket may be a functional pocket for holding items including leashes. The opening in the functional pocket can be a small opening configured to allow a leash or similar attachment held in the pocket to pass through the wall of the bag to a pet outside of the bag. The bag is particularly useful for securely walking a pet hands-free. The invention allows use of both hands for other tasks while securing a pet to its owner. The invention allows for optimal securing of a leash within a bag. This may be beneficial, for example to avoid a need to clip or otherwise secure a leash on the outside of a bag. An optional embodiment of the invention is that it is useful for individuals with limited mobility, particularly with limited mobility of the hands, including but not limited to individuals having multiple sclerosis (MS), arthritis, coordination issues, paralysis, stroke, cerebral palsy, muscular dystrophy, or spinal cord injuries.

An embodiment of the present disclosure includes the bag device comprising a functional pocket located on the inside of the bag. One side of such a functional pocket is attached to the inner wall of the bag. The second side of the functional pocket faces the interior of the bag. A functional pocket may optionally be on the floor of the bag. Another embodiment of the present disclosure is that the functional pocket is used to store one or more items. More specifically, the functional pocket can hold one or more leashes. In yet another embodiment, the functional pocket is used to hold one or more retractable leashes. The functional pocket may vary in size to accommodate items of varying sizes.

Another embodiment of the present disclosure includes a small opening in which one end of the opening is located on said one side of the functional pocket attached to the inner wall of the bag, and the opposite end of the opening is located on the outer wall of the bag. Yet another embodiment of the present disclosure is the opening may be different sizes (width, length, etc.) to accommodate leash tethers of varying thickness. In a preferred embodiment, the opening is a double besom opening.

An optional embodiment of the present disclosure includes a fastener located within the functional pocket. The fastener is attached to one or more sides of the functional pocket. The fastener may be used for securing a leash handle within the functional pocket. The functional pocket may vary in size to accommodate various sized leash handles. Another optional embodiment of the present disclosure includes the capability to seal the functional pocket. Said sealing methods include but are not limited to zippers, buttons, clasps, or press seals. The capability to seal the functional pocket can further secure said leash handle.

In another embodiment the bag device comprises a handle. In yet another embodiment the bag device comprises a shoulder strap. In yet another embodiment, the bag device comprises a crossbody strap. The handles, shoulder straps, or crossbody straps may vary in length and girth, preferably to fit the user and may be adjustable. In yet another embodiment of the present disclosure, two or more shoulder straps may be optionally secured together, for example via a shoulder pad of varying thickness, length, or width.

In another embodiment the bag device comprises a secondary functional pocket. Said secondary functional pocket may be attached to the inside of the bag or the outside of the bag. One side of said secondary functional pocket can be attached to the inner wall of the bag or the outer wall of the bag. Secondary functional pockets may be attached to the inner wall and outer wall of the bag, attached to only the outer wall of the bag, or attached to only the inner wall of the bag. A secondary functional pocket may optionally be on the floor of the bag. A secondary functional pocket may optionally be on the bottom of the outside of the bag.

Yet another embodiment of the present disclosure includes the bag device comprising a secondary functional pocket with the proviso that the secondary functional pocket does not include a small, second opening to the outside of the bag, unless the secondary functional pocket is attached to the outside wall of the bag directly opposite of the functional pocket that is attached to the inside wall of the bag. In one embodiment, one side of the small, second opening is located on the same wall of the bag as the inner functional pocket bag. In another embodiment the secondary functional pocket comprises an additional opening to the outside of the bag. In one embodiment the additional opening is located directly opposite of the small, second opening on an outer wall of the bag which is on a first side of the secondary functional pocket. The second side of the secondary functional pocket faces outward from the outside of the bag. Said second side of the secondary functional pocket in this instance includes yet another small opening in which one side of the small secondary opening is located on the inside of the second side of the secondary functional pocket facing inward to the bag, and the other side of the opening is located on the outside of the second side of the secondary functional pocket facing outward away from the bag. Another embodiment of the present disclosure is that the secondary functional pocket is used to store one or more items. Said items include but are not limited to leashes, retractable leashes, beverage containers, umbrellas, pet toys, pet waste, purse, mobile phone, portable charger, wallet, keys, mail, and groceries. The secondary functional pocket may vary in size to accommodate items of varying sizes.

Another embodiment of the present disclosure includes the bag device may be made from durable material, including but not limited to waterproof material, stiff material, and recycled material.

Other features and aspects of the disclosure are described in detail below.

DETAILED DESCRIPTION OF THE INVENTION

Figure 1:
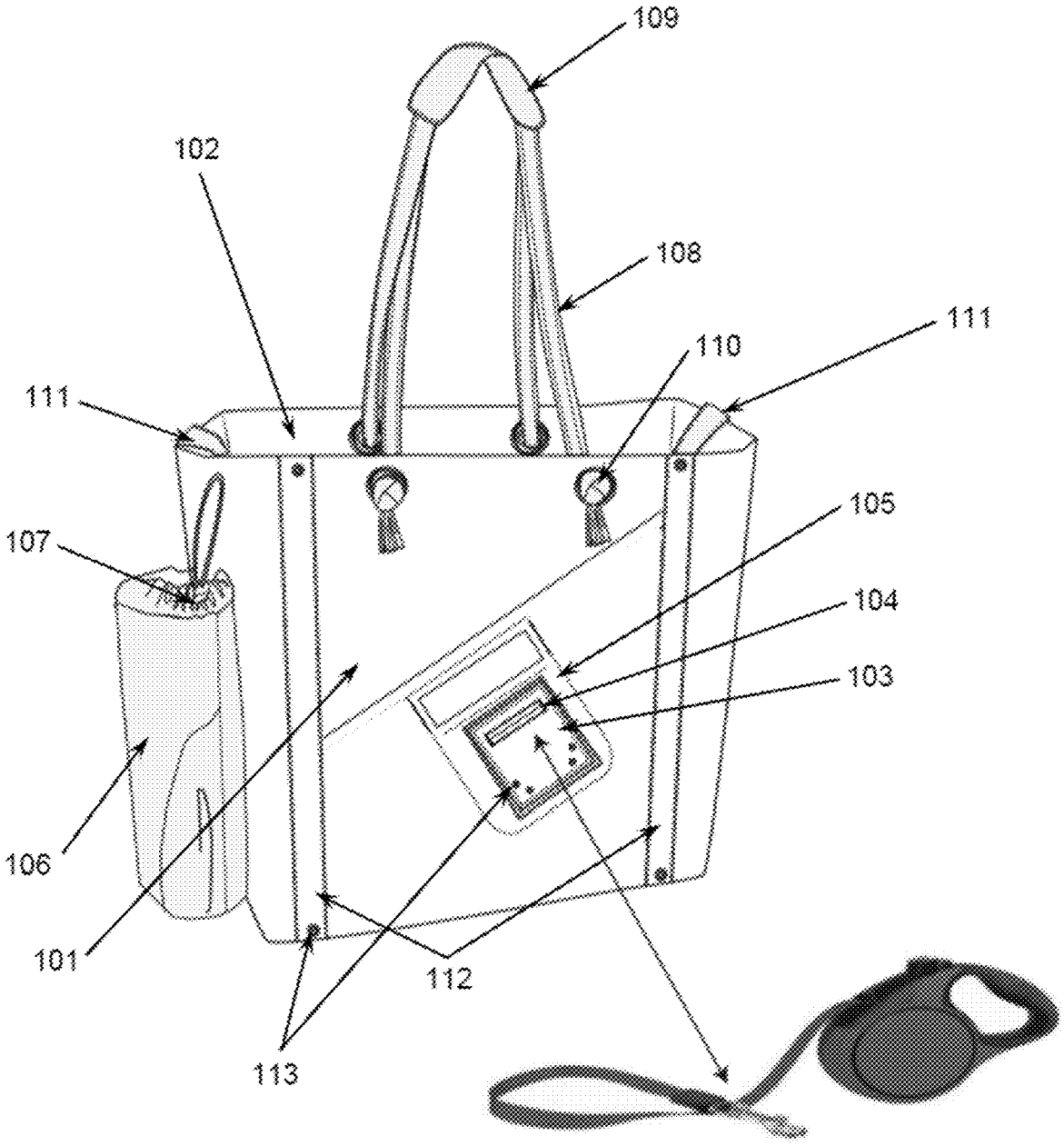
FIG. 1 is a front view of the outside of the bag device in accordance with an embodiment of the present disclosure showing secondary functional pockets.

When introducing elements of the various embodiment(s) of the present disclosure, the articles "a", "an", "the" and "said" are intended to mean that there are one or more of the elements. The terms "comprising", "including" and "having" are intended to be inclusive and mean that there may be additional elements other than the listed elements.

In the present disclosure, "bag" may mean any non-rigid container and can also be known as a tote, sack, carrier, pouch, and receptacle. A bag can be treated as an article of clothing or accessory. A bag has an inner portion comprising an inner wall and a floor, which defines a cavity that is in contact with the items the bag holds or transports. The part of the bag that keeps all items from falling to the ground while a bag is being used is the bottom or floor of the bag. The part of the bag that is attached to and rises up from the bottom of the bag comprises the sides or walls of the bag. A bag has an outer portion on the reverse side of the inner portion of the bag that faces away from the inside of the bag.

In the present disclosure, a pocket is an envelope-like receptacle having two sides, in which the outer portion of one side is attached to or inserted in an article of clothing or accessory to hold items, and is attached or attachable to the bag.

In the present disclosure, a "functional pocket" is an envelope-like receptacle attached to the inside of the bag. The functional pocket includes a small opening in which one side of the opening is located on a first side of the functional pocket attached to the inner wall of the bag, and the opposite side of the opening is located on the outer wall of the bag.

In the present disclosure, a "secondary functional pocket" is an envelope-like receptacle attached to the inside or outside of the bag.

In the present disclosure, an opening can be a hole, slit, gap, or the like, that allows objects to pass through a solid medium. Said opening, hole, slit, or gap passes completely through said medium. This leads to the opening, hole, slit, or gap having two sides, one on each side of said medium. An object can enter one side of the opening/hole/slit/gap of the medium, pass through the medium, and exit from an opposite side of the opening/hole/slit/gap on the other side of the medium. One skilled in the art can appreciate that the medium of the present disclosure includes the wall of the bag device.

In the present disclosure, a double besom opening is a slit with reinforced upper and lower edges.

In the present disclosure, a fastener is a device used to secure an item within the bag. Such devices can include a strap that can be held together with buttons, elastic band, hook and loop fasteners, zipper, snaps, or self-gripping material.

Reference will now be made in detail to specific embodiments or features, which are exemplified in the accompanying figures. References to various elements described herein are made collectively or individually when there may be more than one element of the same type, for instance, "pocket" or "strap". Any reference to an element in the singular may also be construed to relate to plural elements and vice versa without limiting the scope of the disclosure to the exact number or type of such elements. The exemplary embodiments described below are provided for illustrative purposes and should not be construed as limiting. Other exemplary embodiments are possible, and modifications may be made to the exemplary embodiments detailed below within the scope of the disclosure.

Referring to FIG. 1, in one embodiment, the bag device includes an outer portion 101 defined by an inner wall and bottom of the bag. The bag device includes an inner portion 102 comprising an inner wall and a floor that defines a cavity of the bag used for receiving and holding various items, as well as small pets. The outer portion 101 of the bag includes secondary functional pockets 103 and 106. Functional pocket 105 (indicated with dashed lines) is located on the reverse of secondary functional pocket 103, with said functional pocket 105 facing inward within the inner portion 102. The bag device includes a double besom opening, one example seen at 104. A second double besom opening (not shown in this figure) is located on one first side of the functional pocket attached to the wall of the inner portion 102 of the bag, and the opposite side of the second double besom opening (also not shown) is located directly opposite the first side of the functional pocket on the outer portion 101 of the bag, which is the first side of the secondary functional pocket. A second side of the secondary functional pocket 103 faces outward from the outside of the bag. Said second side of the secondary functional pocket includes another, third double besom opening 104. The third double besom opening 104 has a first side (not shown) located on the inside of the second side of the secondary functional pocket, facing inward towards the bag, and the opposite side of the third double besom opening 104 is located on the outside of the second side of the secondary functional pocket 103, facing outward away from the bag. The double besom opening 104 lies adjacent the second double besom opening (not shown in this figure) that spans the one side of the functional pocket 105 on inner portion 102 of the bag, and this opening passes through the material of the bag to the outer portion of the bag 101 where the first side of the secondary functional pocket 103 is found. A second secondary functional pocket 106 is located on the outer portion 101 of the bag. Secondary functional pocket 106 is capable of carrying items including but not limited to an umbrella or pet waste. Secondary functional pocket 106 is sealed with an elastic band and cord lock 107. The bag device includes handle straps 108 with a padded handle 109 are connected to the bag at 110. Padded handle 109 may be used to more comfortable carry the bag device over the shoulder. The bag device also includes a cross-body strap attached to the bag at 111. The bag device is held together at seams 112 reinforced by rivets, e.g. at 113. Rivets 113 also aid in reinforcing the bottom area of the secondary functional pocket 103 and other seams.

Figure 2:
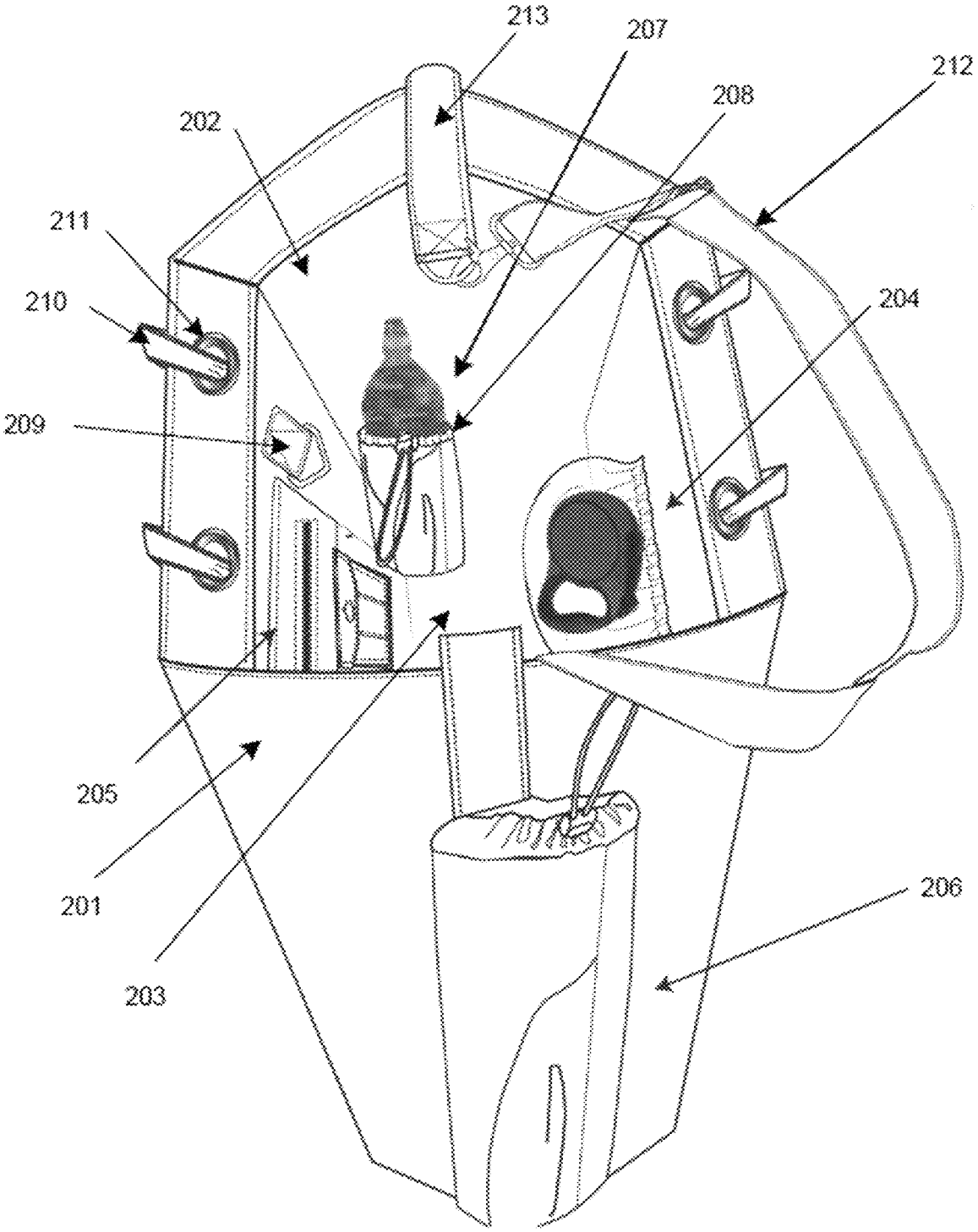
FIG. 2 is a top-down view showing the inside cavity of the bag in accordance with an embodiment of the present disclosure showing a functional pocket and secondary functional pockets.

Referring to FIG. 2, the bag device is shown in a top-down view depicting an outer portion of the bag 201 and an inner portion comprising an inner wall and a floor that defines a cavity of the bag 202. The bottom 203 of the inside portion of the bag defines where various items and/or small pets rest when using the bag. Together, inside wall of the bag 202 and bottom of the inside of the bag 203 define the cavity of the bag. Functional pocket 204 is attached to the inner wall of the bag 202. Functional pocket depicts a retractable leash 204 residing within said functional pocket 204. Secondary functional pockets are shown at 205, 206, and 207. Secondary functional pocket 205 on the inner portion of the bag 202 displays several embodiments for sealing including a zipper and a flap with a button. Secondary functional pocket 206 is another view of the secondary functional pocket 106 from FIG. 1. Secondary functional pocket 207 on the inner the wall of the bag 202 is sealed with an elastic band and cord lock 208. A closed hook hanger 209 is attached to the inner portion of the bag 202. Closed hook hanger 209 can secure items with hooks or loops, including but not limited to keys and carabiners. Handle straps 210 (strap not fully shown), corresponding to 108, are shown with another view of the strap connection 211. The bag device also includes a cross-body strap 212 that is attached to the bag at 213, corresponding to 111.

Figure 3:
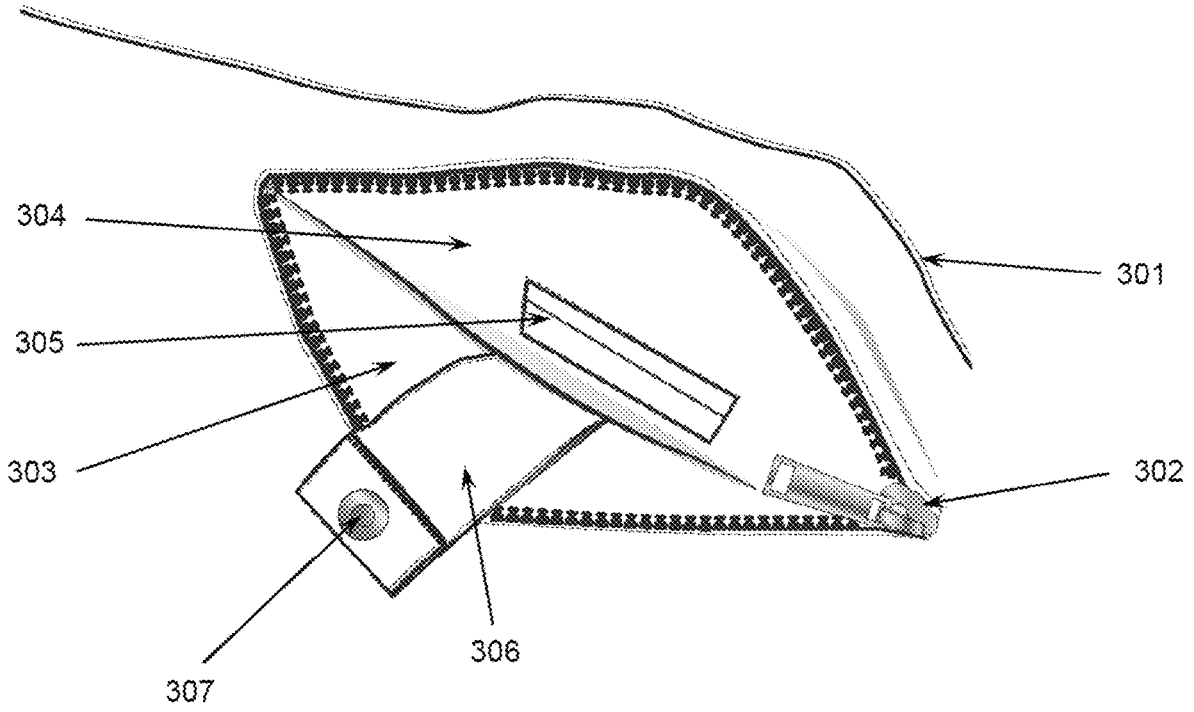
FIG. 3 is an expansion of the functional pocket shown in FIG. 2 that shows the inside of the functional pocket in accordance with an embodiment of the present disclosure having double besom opening and fastener.

FIG. 3 is an expansion of 204 in FIG. 2. This figure is a top-down view of the functional pocket 204 located on the inside or inner portion of the bag. Line 301 represents the boundary between the inner portion of the bag and the outer portion of the bag. The space above the line 301 represents the outer portion of the bag, while the space below the line 301 represents the inner portion of the bag where the functional pocket is attached. The functional pocket is sealed with a zipper 302. The view of the inside of the functional pocket shows a first side 304 attached to the inside wall of the bag, and a second side 303 opposite to the first side of the functional pocket that faces towards the cavity of the bag. Double besom opening 305 is located on the side of the functional pocket 304 that is attached to the inside wall of the bag. The opposite side of double besom opening 305 is located on the outer portion of the bag (not shown in this figure). Fastener 306 is attached to the functional pocket and is capable of securing items within the functional pocket, and has button 307.

In the embodiments of the present disclosure, the material of the bag device, including the walls of the bag, the functional pockets, secondary functional pockets, straps, handles, padded handle, and crossbody attachments may comprise any material commonly associated with a non-rigid bag, including but not limited to woven plant fibers, cotton, leather, plastic, nylon, canvas, jute, and synthetic materials. In another embodiment of the present disclosure, the bag device may comprise waterproof material. In yet another embodiment, the bag device may comprise a buoyant material. In yet another embodiment of the present disclosure, the bag device may comprise a fireproof material.

In one embodiment, the bag of the present invention is useful for walking a pet hands-free. In a particular embodiment, the bag can hold light shopping and a small dog. In another embodiment, the bag is useful for walking a pet for persons with weakness in a hand. For example, the bag can retain a leash and control of a pet even when the person involuntarily lets go of the leash when walking a pet. In one embodiment, therefore, a purpose of the bag is to retain a leash even if it is let go indiscriminately.

In another embodiment, a retractable leash is secured in a pouch inside the bag. A tape leash can easily be threaded through a double besom opening to the outside of the bag and hooked onto a pet's harness, allowing walking a pet hands-free. In a particular embodiment, the bag can allow a user to hide dog waste until reaching a trash can and has pockets to carry the dog's water and waste bags. In one embodiment, a small pet can fit inside the bag if the pet needs to accompany a user into a location that prohibits dogs, such as a store or restaurant. In another embodiment, the bag is large enough to hold mail or groceries, and is a multipurpose bag. The bag in one embodiment is functional for individuals who have a disability.

The description above includes exemplary apparatus, methods, techniques, and/or steps that embody techniques of the present invention. However, it is understood that the described invention may be practiced without these specific details.

What is claimed is:

1. A method for walking a pet hands-free for an individual with physical impairments, comprising:

placing one leash comprising a tether and a hook within a functional pocket of a pet-walking device, the pet walking device comprising:

a. an inner portion comprising an inner wall and a floor that define a cavity;

b. an outer portion;

c. the functional pocket attached to the inner portion; and d. a shoulder strap or cross body strap that is capable of securing the device for transport;

e. wherein the functional pocket comprises an opening;

f. wherein the opening passes through the inner portion and the outer portion;

g. wherein the functional pocket further comprises a fastener attached to the functional pocket and capable of securing the leash to the pocket; and h. wherein the cavity of the inner portion can be used for holding a pet;

securing one end of the leash within the functional pocket via the fastener attached to the inside of the functional pocket;

passing the tether of the leash through the opening to the outside of the bag;

attaching the hook to a harness worn by the pet;

carrying the device hands-free using the shoulder strap or the cross body strap wherein the shoulder strap or cross body strap allows the device to be worn on the individual's side to secure and retain the one leash; and placing the pet within the cavity;

wherein placing the pet within the cavity occurs when the pet accompanies the individual into a location in which containment of the pet is desired.

2. The method of claim 1, wherein the device is a bag.

3. The method of claim 2 wherein the device is a bag capable of being worn by a human.

4. The method of claim 1 wherein the opening is a double besom opening.

5. The method of claim 1, wherein the device further comprises a secondary functional pocket.

6. The method of claim 1, wherein the device further comprises a handle.

7. The method of claim 1, wherein the strap is a shoulder strap.

8. The method of claim 7, further comprising two or more straps.

9. The method of claim 1, wherein the strap is one or more cross body straps.

10. The method of claim 1, wherein the material comprising the bag device is waterproof.

11. The method of claim 1 wherein the opening is smaller than the functional pocket and larger than the diameter of a leash tether.

* * * * *